US006863185B2

(12) United States Patent
Mele et al.

(10) Patent No.: US 6,863,185 B2
(45) Date of Patent: Mar. 8, 2005

(54) LOCKABLE BASEBALL BAT DISPLAY

(76) Inventors: Bill Mele, 14 Blackthorn Place N.E., Calgary, Alberta (CA), T2K 4Y3; Gina S. Mele, 80 Hunterhorn Cres. N.E., Calgary, Alberta (CA), T2K 6J2

( * ) Notice: Subject to any disclaimer, the term of this patent is extended or adjusted under 35 U.S.C. 154(b) by 91 days.

(21) Appl. No.: 10/364,113

(22) Filed: Feb. 10, 2003

(65) Prior Publication Data

US 2004/0155000 A1 Aug. 12, 2004

(51) Int. Cl.[7] ..... E05B 73/00
(52) U.S. Cl. ..... 211/4; 211/60.1; 211/14
(58) Field of Search ..... 211/60.1, 70.6, 211/13.1, 14, 87.01, 85.7, 4, 8, 9, 6

(56) References Cited

U.S. PATENT DOCUMENTS

| | | | | | |
|---|---|---|---|---|---|
| 438,735 | A | * | 10/1890 | Miller et al. | 294/163 |
| 505,320 | A | | 9/1893 | Meadows | |
| 1,204,813 | A | | 11/1916 | Murray | |
| 2,271,702 | A | | 2/1942 | McCartney | |
| 2,376,955 | A | | 5/1945 | Ball | |
| 2,577,988 | A | * | 12/1951 | Wirth | 211/70.6 |
| 2,879,896 | A | * | 3/1959 | Green | 211/4 |
| 3,269,550 | A | * | 8/1966 | Marcus | 211/70.6 |
| 4,049,126 | A | * | 9/1977 | Halverson | 211/104 |
| 4,063,646 | A | | 12/1977 | Stahl, Jr. | |
| 4,113,107 | A | | 9/1978 | Jaeger | |
| 4,300,690 | A | * | 11/1981 | Thomas | 211/4 |
| 4,335,872 | A | * | 6/1982 | Caplis et al. | 269/43 |
| 4,336,885 | A | | 6/1982 | Thomas | |
| 4,641,755 | A | | 2/1987 | Oliver et al. | |
| 4,807,763 | A | | 2/1989 | Jankovsky | |
| 5,054,625 | A | | 10/1991 | Foley | |
| 5,085,326 | A | * | 2/1992 | Russell et al. | 211/4 |
| 5,129,528 | A | * | 7/1992 | Eidsmoe et al. | 211/70.6 |
| 5,160,048 | A | * | 11/1992 | Leyden et al. | 211/7 |
| 5,520,291 | A | * | 5/1996 | Graham | 211/4 |
| 5,626,244 | A | * | 5/1997 | Mesna et al. | 211/60.1 |
| 5,690,235 | A | * | 11/1997 | Matzen | 211/60.1 |
| 5,701,998 | A | | 12/1997 | Perry et al. | |
| 5,829,590 | A | * | 11/1998 | Klein | 206/369 |
| 6,089,383 | A | * | 7/2000 | Heneveld | 211/14 |
| 6,142,313 | A | * | 11/2000 | Young | 211/4 |
| 6,142,319 | A | | 11/2000 | Kim | |
| 6,241,105 | B1 | | 6/2001 | Pomper | |
| 6,360,902 | B1 | | 2/2002 | Searies | |
| 6,481,583 | B1 | * | 11/2002 | Black et al. | 211/70.6 |
| 6,536,611 | B2 | * | 3/2003 | Chen | 211/70.6 |
| 6,679,391 | B1 | * | 1/2004 | Huang | 211/70.6 |

* cited by examiner

*Primary Examiner*—Leslie A. Braun
*Assistant Examiner*—Khoa Tran
(74) *Attorney, Agent, or Firm*—Gene Scott; Patent Law & Venture Group

(57) ABSTRACT

A display apparatus for baseball bats provides a receiver having a plurality of bat support apertures arranged in descending positions from a rear surface of the receiver to a front surface of the receiver. The apertures are accessed from side surfaces of the receiver for inserting and removing baseball bats into the apertures for storage therein. A U-shaped locking bar is hinged distally at the side surfaces of the receiver for vertical rotation between a raised position allowing access to the baseball bats stored in the receiver, and a lowered position preventing access to the bats. The locking bar is therefore positionable along both of the sides of the receiver for blocking the apertures. A lock may be placed for preventing the locking bar from being raised.

5 Claims, 2 Drawing Sheets

LOCKABLE BASEBALL BAT DISPLAY

BACKGROUND OF THE INVENTION

INCORPORATION BY REFERENCE

Applicant(s) hereby incorporate herein by reference, any and all U.S. patents, U.S. patent applications, and other documents and printed matter cited or referred to in this application.

1. Field of the Invention

This invention relates generally to retail display racks and more particularly to such a rack with sloped design and locking feature.

2. Description of Related Art

The following art defines the present state of this field:

Meadows, U.S. Pat. No. 505,320 describes a rotatable rack for firearms, the combination of a central post, a lower platform around said post adapted to hold the butts of funs or rifles, an upper platform recessed to receive within it the muzzle ends of the funds, and provided with locking catches to separately hold them therein, and a rising and falling cap adapted to collectively secure the muzzle ends of the funds within the upper platform.

Murray, U.S. Pat. No. 1,204,813 describes an Indian club rack comprising, a bar adapted to be secured to a wall and provided with a plurality of U shaped slots in its outer edge; blocks slidably mounted on the under face thereof and provided with L shaped slots in their outer edges adapted to cooperate with the U shaped slots, the said blocks being further provided with longitudinal slots near their ends; pins secured through the said bar and passed through the said slots and headed; washers secured on said pins beneath the said blocks; a lock carried by the inner end of one of the said blocks; and a locking plate carried in the inner end of the other of said blocks.

McCartney, U.S. Pat. No. 2,271,702 describes a rack comprising a bottle container, a swingable top structure pivoted on the container for embracing the neck portions of bottles, and detent means between the top structure and the container, said detent structure comprising a beveled member rising from the container, said top structure having an opening therein for partly receiving the beveled member and a lock having a retractable bolt carried by the underside of the top structure and disposed in the path of the beveled member.

Ball, U.S. Pat. No. 2,375,955 describes a milk pipe rack having a base, an elongated cylindrical pivot secured at its lower end to the base and projecting vertically therefrom, means for supporting milk pipes comprising a spool having a hub and end flanges, the hub having an opening, extending its entire length, for the reception of the pivot, cooperating means on the pivot and on the spool for rotatably supporting the end flanges of the spool having an even number of radially spaced notches extending inwardly from their peripheries, alternate notches being of greater depth than the others, corresponding deep and shallow notches being positioned in the same radial planes, the width of the space between adjacent notch walls being substantially equal, and spring detents having bases positioned against and secured to those portions of the flanges between the notches, the ends of the spring detents being positioned, in adjacent notches, the ends projecting into the notches being concave on the side facing the wall surfaces of the notches, the carved ends being flexible.

Halverson, U.S. Pat. No. 4,049,126 describes a portable bat rack having a first configuration attachable to a fence for the storage of baseball bats and a more compact second configuration of smaller dimensions for transporting the bat rack. The bat rack is front suspended adjacent each end minimizing tilting by partially equalizing the moments caused by the weight of the bats. A shelf-like first support bar is provided with individual forward opening recesses spaced laterally to independently receive each bat in a substantially vertical position. A bat receiving second support bar is provided and is detachably connected to the first support bar thereby allowing end-to-end coplanar abutting of the adjacent support bars in first configuration. A pair of hangers are pivotally attached to the first support bar near each end for attaching the bat rack to an open weave fence. A third hanger is pivotally attached to the outward end of the second support bar. Each hanger is rotatable against its respective support bar in the second configuration thereof. The hinge is separable allowing the first support bar to be used independently without the second support bar in the event a lesser amount of bat stowage is required.

Stahl, Jr., U.S. Pat. No. 4,063,646 describes a fixed fishing rod receiving member with an opposed latch member swingably secured thereto. Spaced hook shaped extensions on the rod receiving member underlie the rods and spaced pins extending toward the rod receiving member and carried by the latch member overlie the rods. A block of resilient material is carried between the hooks and the pins to grasp and cushion the rods within the rack when closed. Lock means are provided to secure the rods in place within the device.

Jaeger, U.S. Pat. No. 4,113,107 describes an upstanding rack including upstanding horizontally spaced apart opposite side uprights, horizontal base structure extending between the lower ends of the uprights and a horizontal brace extending between upper portions of the uprights. The base includes structure for supporting the lower butt bends of a plurality of upstanding long guns therefrom at points spaced therealong and the brace includes longitudinally spaced horizontally facing abutment surfaces spaced therealong against which upper end portions of the long guns may be abutted. Horizontally registered portions of the uprights spaced above the base and below the abutment surfaces include support portions and a rigid elongated horizontal support and a lock member is longitudinally removably insertable through one of the support portions toward and into interlocked engagement with the other support portion. An elongated rigid and horizontal shield member is removably receivable between the support portions and includes horizontally aligned opposite end guides through which the support and lock members removably telescopingly received. The shield member defines a laterally outwardly opening cavity therein extending longitudinally thereof and in which the support and lock member is received and the lock member may be lengthwise inserted through the trigger guards of upstanding long guns supported from the base of the rack with the trigger guards of the long guns snugly received within the cavity of the shield member.

Thomas, U.S. Pat. No. 4,336,885 describes a security display rack for articles comprising an elongated outer channel having first and second legs, a web interconnecting the legs, and a plurality of notches extending through the legs and opening at the outer edges of the legs. An inner channel having first and second legs and a web interconnecting the legs of the inner channel are received in the outer channel with the legs of the inner channel extending from the web of the inner channel toward the web of the outer channel. A plurality of pins is carried by the web of the inner channel and is adapted to engage one of the articles with such article projecting through the grooves in the outer channel. A locking member is mounted on the channel for opening and closing the ends of the grooves.

Oliver et al., U.S. Pat. No. 4,641,755 describes a stowage rack unit consisting of a plurality of upright stanchions to provide a basic rack framework. The rack includes upper clamps and collars to restrict upward and horizontal motion of the projectiles. The collars have a two-piece threaded arrangement which allows adjustment to accommodate minor variations in projectile length. Lower clamps are provided for additional restraint against horizontal motion of the projectiles. Base plates are provided to support and restrict downward motion of the projectiles and side channels receive and secure the clamps and base plates. Additional special brackets are provided for attaching racks to bulkheads or for joining adjacent racks. To load the rack, side channels are attached to the stanchions and base plates are inserted into the lower pair of side channels and secured with pins. Individual upper and lower clamps are inserted into upper and middle side channels respectively and secured with pins. Projectiles are loaded vertically into receiving slots in the upper and lower clamps and an additional set of upper and lower clamps are inserted into their respective side channels and secured. The projectiles are locked in place by the two-piece collars, which are secured by a quick release bolt. The process is repeated for each row of projectiles until the rack is completely loaded.

Jankovsky, U.S. Pat. No. 4,807,763 describes a portable, light-weight storage stand for baseball and softball bats which has two arms with eight to twelve apertures to receive bats lowered therethrough. The arms are slideably received through sector slots in the wall of a central tubular support member held vertical by base cross leg pieces engaging the tubular support member's slotted lower end. When disassembled, the arms and base pieces are stored inside the tubular support member retained by two end caps, and the packed tube may be stored in a duffel bag with the bats.

Foley, U.S. Pat. No. 5,054,625 describes a portable bat rack that is generally shaped in the form of an equilateral triangle with larger sides of the triangular subtending the front and back of the rack while the smallest side subtends the bottom of the rack. The rack is closed at bottom and back and along the sides and carries three laterally disposed shelves, the lowest shelf being no greater than one-half the width the other two shelves, the other two shelves relatively disposed above the smallest shelf and defining a plurality of bat accommodating apertures, preferably in an array of two parallel rows, a forward and rearward row. The rearward row of openings allows bats placed therethrough to rest on the smallest shelf while the forward row of openings allows the bats to rest on the bottom. The rack includes a pair of wheels and handle means whereby it may be, on the one hand, placed stationery on the ground to tip the bats forward and display them in two rows at different elevation; alternatively pulled by a handle so as to roll over the ground or allowing the same to be picked up and placed into a trunk of a vehicle with two handles.

Russell et al., U.S. Pat. No. 5,085,326 describes a load lock holder comprising a base plate for mounting the load lock holder to a wall of the tractor or trailer and multiple clips made of a resilient material mounted to the base plate, each retaining clip defining a clamping area for holding the load lock and a slot located on one side of the retaining clip through which a load lock may be forced before the load lock enters the clamping area of the clip. Additionally, a retaining gate may be used to provide an additional securing force to the load locks in the load lock holder. A cushion may be coupled to the retaining gate for positively engaging the load locks to prevent the load locks from moving relative to the load lock holder.

Perry et al., U.S. Pat. No. 5,701,998 describes a bat handle cover for encasing the grip area of a bat handle and for suspending the bat by a chain and clasp from a suspending structure. The cover may be made of stiff material, and include either a number of locking balls, a ring or a pair of U-shaped latches near the inside top of the cover, which grasp the bat handle just below the enlarged butt end or head of a conventional baseball bat. The cover may be made of flexible material, and include a necked-in portion which engages the bat. The flexible cover may have a full length slit closed by hook and loop fasteners about the bat handle, or a zipper closure running most of the length of the cover. A lower, open end of the cover may include a seal, to prevent water, moisture and/or debris from entering the interior of the cover.

Kim, U.S. Pat. No. 6,142,319 describes a locking device for securing golf clubs comprising at least two main elements: a base plate and a locking plate. The base plate has a plurality of notches formed on its outer periphery for receiving the shafts of one or more golf clubs. The locking plate with a plurality of hooks is rotatably mounted on the base plate. A golf club inserted into a notch is retained in place upon rotation of the locking plate. A lock mechanism can be added such that when it is engaged, it locks the plates against rotation.

Pomper, U.S. Pat. No. 6,241,105 describes a jewelry display stand including a vertical post assembly mounted on a base. A plurality of arms, serving as hanger elements for jewelry or other merchandise, radiate from the post. The arms co-operate with anti-removal elements on the post that prevent merchandise from being removed from the spokes. In one embodiment a ring engaging the tips of the arms provides the anti-removal elements. In another embodiment the anti-removal elements are a set of spokes above the arms. Either the arms or the spokes are movable up and down and are spring-biased upwards, to a position in which the arms are separated from the anti-removal elements and merchandise can be removed from or placed on the arms. A cap on the post engages the movable elements, holding them down, and keeping the arms engaged with the ring or spokes. A slot in the cap allows one arm or spoke to rise to the non-engaging position, and the cap is rotatable about a vertical axis so that the slot can be aligned with any selected arm or spoke. Thus, merchandise can be removed from only the selected arm, reducing the risk of pilferage.

Searles, U.S. Pat. No. 6,360,902 describes a storage system for fishing poles. The storage system includes a platform adapted to rest on a boat deck. An upper surface of the platform includes receptacles to receive the butt ends of fishing poles placed in the storage system. A frame extends upwardly from the platform and supports a rectangular member above and vertically oriented with respect to the platform. Notches are formed along and into one edge of the rectangular member, corresponding one to one with receptacles on the upper surface of the platform, with which they are aligned. An arm is pivotally attached with respect to the frame to close and open along the major edge of the rectangular member including the plurality of notches. A lock is provided for securing the arm against the major edge.

The prior art teaches a rack for firearms, a locking rack for Indian clubs, a rack for milk bottles, a rack for milk pipes, a rack for baseball bats, a latching rod rack, a machine gun rack, a security display rack, a projectile stowage rack, a stand for baseball bats, a wheeled bat rack, a load lock holder, a baseball bat cover, a locking rack for golf clubs, a circular display stand, and a fishing rod rack, but does not teach a locking display rack with sequentially lower portions for improved display visibility. The present invention fulfills these needs and provides further related advantages as described in the following summary.

SUMMARY OF THE INVENTION

The present invention teaches certain benefits in construction and use which give rise to the objectives described below.

A display apparatus for baseball bats provides a receiver having a plurality of bat support apertures arranged in descending positions from a rear surface of the receiver to a front surface of the receiver. The apertures are accessed from side surfaces of the receiver for inserting and removing baseball bats into the apertures for storage therein. A U-shaped locking bar is hinged distally at the side surfaces of the receiver for vertical rotation between an raised position allowing access to the baseball bats stored in the receiver, and a lowered locked position preventing access to the bats. The locking bar is therefore positionable along both of the sides of the receiver for blocking the apertures. A lock may be placed for preventing the locking bar from being raised.

A primary objective of the present invention is to provide an apparatus and method of use of such apparatus that provides advantages not taught by the prior art.

Another objective is to provide such an invention capable of advantageously displaying baseball bats.

A further objective is to provide such an invention capable of locking the baseball bats as displayed.

A still further objective is to provide such an invention capable of easily gaining access to the baseball bats when necessary.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention in at least one of its preferred embodiments, which is further defined in detail in the following description.

Figure 2:
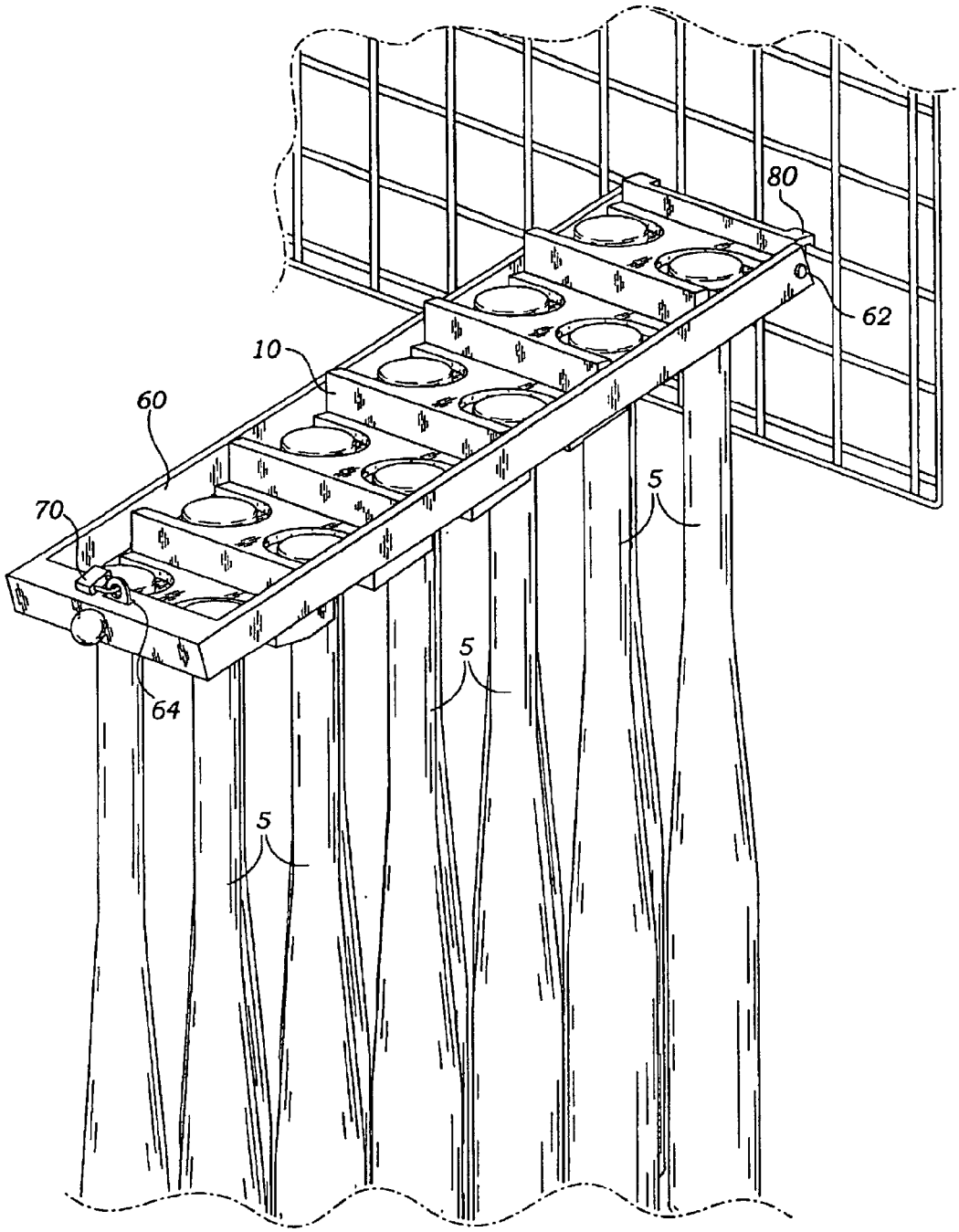

The present invention is a display apparatus comprising a baseball bat receiver 10, is preferably made of metal or plastic, and has a plurality of bat support apertures 20 arranged in descending positions from a rear surface 30 of the receiver 10 to a front surface 40 of the receiver 10 so as to provide improved viewing of the bats by retail customers. The apertures 20 are open to side surfaces 50, 50' of the receiver 10 for enabling the inserting and removing of baseball bats 5 into the apertures 20. A U-shaped locking bar 60 is hinged distally at the side surfaces 50, 50' of the receiver 10 for vertical rotation about hinge pins 62 in the receiver 10. The locking bar 60 is positioriable to a lowered attitude, shown in FIG. 2, along both of the side's surfaces 50, 50' of the receiver 10 for locking the bats 5 within the apertures 20. A means for locking 70, such as hasp 12 and slot 64 and pad lock 70 are positioned near the front surface 40 for locking the locking bar 60 in the lowered position, so that it cannot be raised without removing the padlock 70 from hasp 12, thereby providing the ability to prevent unwanted access to the apertures 20 and bats 5. Alternately, holes 13 in the locking bar and the front surface 40 may are aligned for accepting a padlock.

Preferably, the rear surface 30 of the receiver 10 provides an apparatus mounting means 80, such as a hook-shaped flange, shown in the figures, or a clamp or other fastener.

Figure 1:
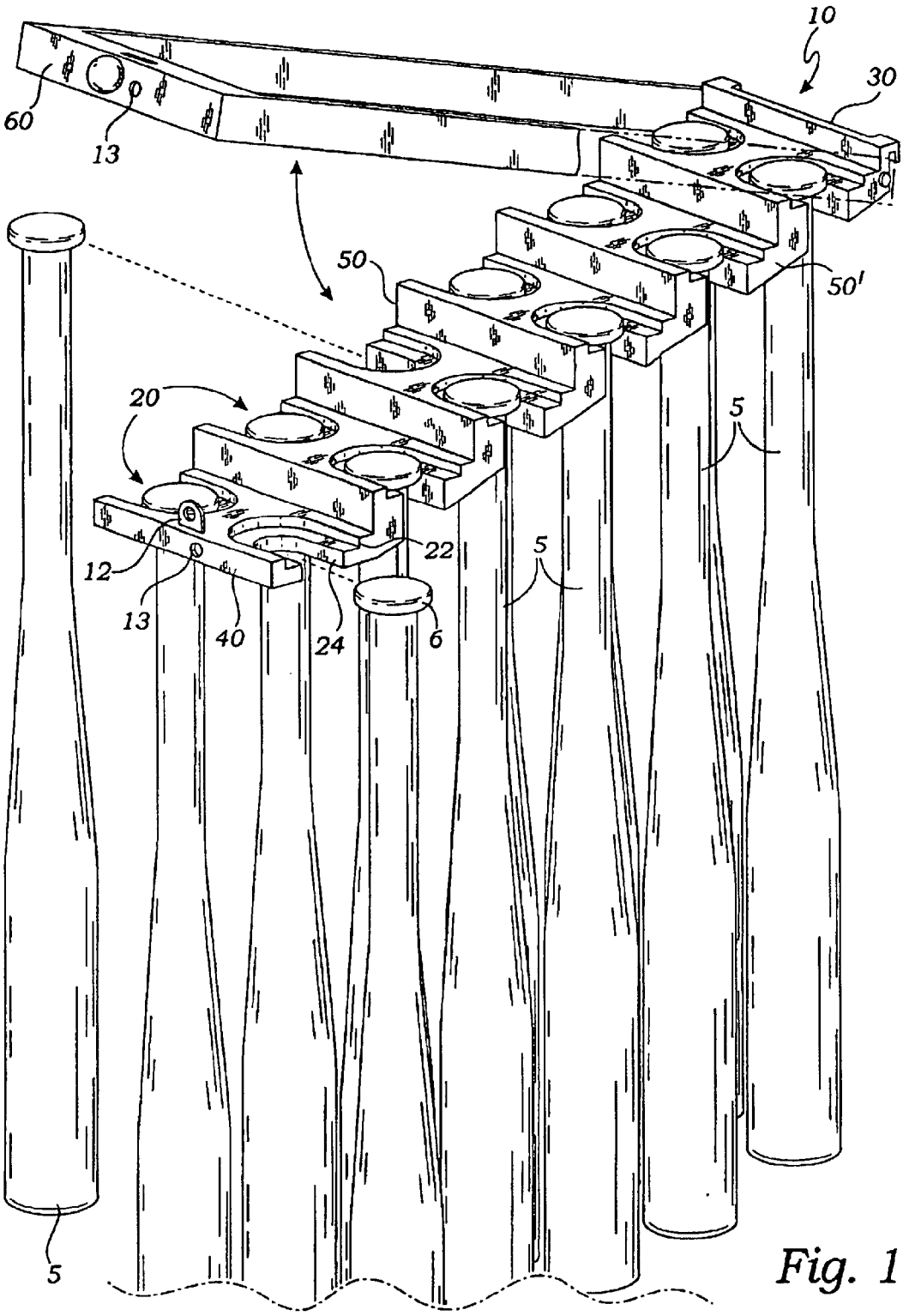
FIGS. 1 and 2 are similar perspective views of the preferred embodiment of the invention with FIG. 1 showing a locking bar in a raised attitude, and FIG. 2 showing the locking bar in a lowered and lock attitude.

Preferably, the apertures 20 are positioned in pairs at each of the descending positions and are adapted, by being open to the side surfaces 50, 50' for receiving the baseball bats 5 therein by opposing lateral insertions, i.e., from the sides. This is clearly shown in FIG. 1.

Preferably, the apertures 20, each provide an upper portion 22 greater in width than a knob 6 of the baseball bat 5, and a lower portion 24 of smaller width than the knob 6 of the baseball bat 5, the lower portion 24 thereby enabled for supporting the baseball bat 5 suspended by its knob 6 with the bat 5 in a vertical inverted position as shown in the figures.

While the invention has been described with reference to at least one preferred embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. A display apparatus comprising: a baseball bat receiver having a plurality of bat support apertures arranged in descending positions from a rear surface of the receiver to a front surface of the receiver, the apertures open to side surfaces of the receiver for inserting and removing baseball bats into the apertures; a U-shaped locking bar hinged distally at the side surfaces of the receiver and enabled for vertical rotation, the locking bar positionable along both of the sides of the receiver for blocking the apertures; a means for locking the locking bar for preventing the locking bar from being rotated.

2. The apparatus of claim 1 wherein the rear surface of the receiver provides an apparatus mounting means.

3. The apparatus of claim 2 wherein the mounting means is a hook shaped flange mounted integrally with the rear surface of the receiver.

4. The apparatus of claim 1 wherein two of the apertures are positioned at each of the descending positions, the apertures adapted for receiving baseball bats therein by opposing lateral insertions.

5. The apparatus of claim 1 wherein the apertures each provide an upper portion greater in width than a knob of a baseball bat, and a lower portion of smaller width than the knob of the baseball bat, the lower portion thereby adapted for supporting the baseball bat suspended by the knob of the baseball bat.

* * * * *